United States Patent [19]

Jackman

[11] 4,279,643

[45] Jul. 21, 1981

[54] MAGNESIUM BEARING COMPOSITIONS FOR AND METHOD OF STEEL DESULFURIZATION

[75] Inventor: Joseph R. Jackman, New Castle, Pa.

[73] Assignee: Reactive Metals & Alloys Corporation, West Pittsburgh, Pa.

[21] Appl. No.: 138,861

[22] Filed: Apr. 8, 1980

[51] Int. Cl.[2] ..... C21C 7/02

[52] U.S. Cl. ..... 75/58; 75/53; 75/257

[58] Field of Search ..... 75/53, 58, 257

[56] References Cited

U.S. PATENT DOCUMENTS

| | | | |
|---|---|---|---|
| 4,014,685 | 3/1977 | Jones | 75/53 |
| 4,039,320 | 8/1977 | Uemura | 75/53 |
| 4,040,818 | 8/1977 | Clegg | 75/53 |
| 4,137,072 | 1/1979 | Kawakami | 75/53 |
| 4,142,887 | 3/1979 | Luyckx | 75/58 |

*Primary Examiner*—P. D. Rosenberg

*Attorney, Agent, or Firm*—Buell, Blenko, Ziesenheim & Beck

[57] ABSTRACT

An injectable desulfurizing compound containing about 70% to about 95% fine mesh pulverized burnt lime, zero to about 20% fine mesh acid or ceramic grade fluorspar and about 1% to about 15% minus 20 mesh pure magnesium, salt coated magnesium, or magnesium-aluminum alloy powders for steel desulfurization.

14 Claims, No Drawings

MAGNESIUM BEARING COMPOSITIONS FOR AND METHOD OF STEEL DESULFURIZATION

This invention relates to magnesium bearing compositions for and method of steel desulfurization and particularly to injectable pre-blended compositions containing magnesium that are used for desulfurization in the steel ladle and a method of steel ladle desulfurization for fully killed type steels.

Continuing emphasis on improved formability and surface quality of flat rolled products has put pressure on steel producers to lower the maximum allowable sulfur in many grades of steel. The importance of low sulfur and sulfide shape control becomes a bigger problem everyday with the quest for tougher specifications on high strength low alloy steels for light weight automotive parts, offshore oil and gas drilling platforms, artic line pipe, ship plates and the increased performance required of many tubular products.

Today, the most widely accepted approach to low sulfur steels in large integrated steel plants is a hot metal desulfurization station between the blast furnace and steel plant. Many patents and publications cover that area. Other sources of sulfur after hot metal desulfurization enter into play, however, mostly the scrap charge (open hearth, electric and basic oxygen furnaces) and the fuels (open hearth) which may, in many cases, cancel the effect of the hot metal desulfurization program carried out after the blast furnace. Some modern steel applications require such low sulfur residuals (0.005% max.) that the only sure way to achieve these specifications is to work both on hot metal and steel in a two-step desulfurization program thereby rendering steel ladle desulfurization an increasingly necessary proposition.

Over the past several years, steel ladle desulfurizing mixes have been proposed in response to this need and met with considerable commercial success. However, it was quickly recognized that the technique was not generally applicable to all semi-killed steels and not at all to rimming steels. In addition, amplitude and consistency of desulfurization was inversely proportional to the tap carbon content of the steel. In practice, these prior art desulfurizing mixes would not work well on extra-low carbon steels tapping between 0.02 and 0.10% carbon. Finally, the soda ash content of these prior art mixes produces an inordinate amount of smoke and could be objectionable to health and ladle refractory life.

Most of the steel ladle desulfurizing techniques consisted of dumping or charging bagged or bulk pallet boxes containing compositions of lime, fluorspar, metallic aluminum, and silicon directly into the ladle before or during tap. (U.S. Pat. No. 4,142,887 Steel Ladle Desulfurization Compositions and Methods of Steel Desulfurization). Effective desulfurization using this technique depended on many factors. Some of these were the size of the ladle, tapping rate, configuration of tapping stream, and of course carbon contents of the grade being treated. In general, physical agitation is necessary for intimate contact of the desulfurizing material and the molten steel to produce effective results. In many cases, the same desulfurizer used on the same grade of steel produced in different shops would not result in the same percent of desulfurization because of these differences in tapping conditions between those shops.

The present invention provides an effective inexpensive injectable desulfurizing compound containing about 70% to about 95% fine mesh pulverized burnt lime, zero to about 20% of a member from the group consisting of fine mesh acid or ceramic grade fluorspar and about 1% to about 15% of a member from the group consisting of minus 20 mesh pure magnesium, salt coated magnesium, and magnesiumaluminum alloy powders.

The present invention provides effective desulfurization on all grades of fully killed steels regardless of ladle size, tapping rates, carbon content, or other limiting factors which prohibit desulfurization above the 50% level. Normal expected removal of sulfur by adding desulfurizing compounds into the ladle before or during tap usually results in 35% to 45% reduction using 6 to 10 lbs. of material per tone of steel treated.

I provide an injectable desulfurization mixture which will remove 65% to 84% of the sulfur from either high or low carbon steels which include HSLA (high strength low alloy grades) containing about 0.015% to about 0.035% sulfur by injecting these magnesium bearing compositions at the rate of about 6 pounds per ton of steel treated in a carrier such as argon. Sulfur levels of 0.005% have been consistently achieved using these injectable magnesium bearing compositions. The level of desulfurizing efficiency drops off significantly when tap sulfurs are below 0.015%. Normal steelmaking practices can economically reduce the level of sulfur below 0.035% in the furnace. Desulfurization from the 0.035% level can more economically be handled by steel ladle desulfurization techniques.

Many problems have been associated with attempting to inject powdered compositions containing magnesium into steel for desulfurization. The main problem has been finding a composition which would allow injection at a controlled rate to prevent violent splashing and ejection of molten slag and steel from the ladle. In addition, problems have been incurred with segregation of various components such as magnesium, because of variation in density, particle size, and particle shape, which have caused serious fluidization or injection problems.

Certain compositions of magnesium, lime, and fluorspar as well as disregard to raw material sizing can lead to serious injection problems. Segregation in these pre-blended mixes and mixes containing more than 15% magnesium could potentially cause injection problems and even create an explosion hazard. This invention provides a correct combination of raw materials, properly sized and blended, that minimizes segregation and produces a homogenous product that maximizes desulfurization at a low cost relative to other desulfurization techniques available today. This material can be injected by most all of the commercially available injectors. Individual injector equipment may need minor modification or control adjustment for efficient flow characteristics to maximize desulfurization. Most steel plants having injectors and injection technology can make the necessary minor modifications to successfully use this invention.

The state of the art is well known for hot metal desulfurization. Many different compositions of lime and magnesium are being used to successfully desulfurize hot metal. The practice of hot metal desulfurization with mixtures of lime and magnesium are normally done in submarine ladles containing hot metal which is normally in the range of 2400° F. to 2600° F. These same compositions which are successfully used in hot metal could not possibly be used in the steel ladle because of the 400° F. to 500° F. higher temperature. The higher temperature of the steel, because of the high volatility of the magnesium, would be absolutely too violent for steel desulfurization. Because of this, very little work has been done in the area of steel desulfurization with magnesium.

This invention of a pre-blended mix of lime, fluorspar and magnesium, does not segregate in shipment from the producer to the steel plant nor does it segregate in the injector vessel or transport line. A small amount of a flow aid or fluidizing agent such as Dow Chemical Company's "Silicon Flow Aid" (hydroxylated polydimethylsiloxane) may be added to make the product more free flowing during injection.

Injection rates of approximately 122 lbs. per minute were used in one steel plant to treat a series of 200 ton heats. Six pounds of the pre-blended mix was used per net ton of treated steel. A total of 14 heats were produced on a 0.12% carbon maximum silicon-aluminum killed HSLA steel which had various tap sulfur levels.

This invention can best be understood by reference to the following examples.

EXAMPLE I

A series of six 200 ton basic oxygen furnace heats of silicon-aluminum killed steel were treated with a composition according to this invention of 75% pulverized burnt lime, 20% fine mesh ceramic grade fluorspar, 5% pure minus 30 mesh magnesium powder, and a flow aid or fluidizing agent such as Dow Chemical Company's "Silicon Flow Aid" in an amount equal to about 2 lbs./ton of lime in the mixture to make the mixture more free flowing during injection. The results appear in Table I.

TABLE I

| Heat | Tap Carbon | Weight of Mix | Tap Sulfur | Final Sulfur | Percent Desulfurization |
|---|---|---|---|---|---|
| A | 0.12% | 1200 lbs | .030% | .005% | 83% |
| B | 0.12% | 1200 lbs | .029% | .009% | 70% |
| C | 0.12% | 1200 lbs | .014% | .005% | 64% |
| D | 0.12% | 1200 lbs | .014% | .005% | 64% |
| E | 0.12% | 1200 lbs | .014% | .005% | 64% |
| F | 0.12% | 1200 lbs | .008% | .005% | 38% |

EXAMPLE II

A series of eight 200 ton basic oxygen heats of silicon-aluminum killed steel were treated with a composition according to this invention containing 95% pulverized burnt lime, 5% pure minus 30 mesh magnesium powder, and a small amount of flow aid or fluidizing agent. The results appear in Table II.

TABLE II

| Heat | Tap Carbon | Weight of Mix | Tap Sulfur | Final Sulfur | Percent Desulfurization |
|---|---|---|---|---|---|
| A | 0.09% | 1200 lbs | .032% | .007% | 78% |
| B | 0.09% | 1200 lbs | .027% | .005% | 81% |
| C | 0.09% | 1200 lbs | .027% | .007% | 74% |
| D | 0.09% | 1200 lbs | .021% | .005% | 76% |
| E | 0.09% | 1200 lbs | .021% | .005% | 76% |
| F | 0.09% | 1200 lbs | .021% | .005% | 76% |
| G | 0.09% | 1200 lbs | .015% | .005% | 67% |
| H | 0.09% | 1200 lbs | .010% | .005% | 50% |

It is apparent from the foregoing examples that the compositions and practice of this invention will effectively and economically desulfurize molten steel by injection of these pre-blended mixtures into the steel in the ladle after tapping from the basic oxygen furnace, electric furnace, or open hearth steel making processes.

In the preceding specifications, I have set out certain preferred embodiments and practices of my invention, however, it will be understood that this invention may be otherwise embodied within the scope of the following claims.

I claim:

1. An injectable pre-blended desulfurization composition for desulfurizing molten steel which excludes sodium carbonate as an added ingredient and provides a marked reduction in fuming with improved sulfur removal, particularly in low-carbon steels consisting essentially of a mixture of particulate lime, particulate fluorspar and at least one member from the group consisting of particulate metallic magnesium and magnesium alloys proportioned to provide effective desulfurization.

2. An injectable pre-blended desulfurization composition for desulfurizing molten steel which excludes sodium carbonate as an added ingredient and provides a marked reduction in fuming with improved sulfur removal, particularly in low-carbon steels consisting essentially of a mixture of particulate lime and at least one member from the group consisting of particulate metallic magnesium and particulate magnesium alloys proportioned to provide effective desulfurization.

3. An injectable pre-blended desulfurization composition as claimed in claim 1 consisting essentially by weight of about 70% to about 95% particulate lime, about 0% to about 20% particulate fluorspar, and about 1% to 15% of at least one member from the group consisting of particulate magnesium and particulate magnesium alloys.

4. An injectable pre-blended desulfurization composition as claimed in claim 3 having 1% to 15% particulate magnesium.

5. An injectable pre-blended desulfurization composition as claimed in claim 2 consisting essentially by weight of 90% to about 98% particulate lime and about 2% to 10% of at least one member from the group consisting of particulate magnesium and particulate magnesium alloys.

6. An injectable pre-blended desulfurization composition as claimed in claim 3 having 2% to 10% particulate magnesium.

7. Injectable pre-blended steel ladle desulfurization compositions as claimed in claim 1 or 2 or 3 or 4 or 5 or 6, wherein all ingredients are less than 30 mesh in particle size.

8. A method of ladle desulfurization of molten steel which excludes sodium carbonate as an added ingredient and provides a marked reduction in fuming with improved sulfur removal, particularly in low-carbon steels consisting of injecting about 4 to 10 lbs. of a pre-blended desulfurization mixture consisting essentially of particulate lime, particulate fluorspar and at least one member from the group consisting of particulate metallic magnesium and magnesium alloys proportioned to provide effective desulfurization, with a carrier gas or argon per ton of steel.

9. A method of ladle desulfurization of molten steel which excludes sodium carbonate as an added ingredient and provides a marked reduction in fuming with improved sulfur removal, particularly in low-carbon steels consisting of injecting about 4 to 10 lbs. of a pre-blended desulfurization mixture consisting essentially of particulate lime and at least one member from the group consisting of particulate metallic magnesium and particulate magnesium alloys proportioned to provide effective desulfurization, with a carrier gas of argon per ton of steel.

10. A method as claimed in claim 8 wherein the injected mixture consists essentially of about 70% to about 95% particulate lime, about 0% to about 20% particulate fluorspar, and about 1% to 15% of at least one member from the group consisting of particulate magnesium and particulate magnesium alloys.

11. A method as claimed in claim 9 wherein the injected mixture consists essentially of 1% to 15% particulate magnesium.

12. A method as claimed in claim 8 wherein the injected mixture consists essentially of 90% to about 98% particulate lime and about 2% to 10% of at least one member from the group consisting of particulate magnesium and particulate magnesium alloys.

13. A method as claimed in claim 9 wherein the injected mixture consists essentially of 2% to 10% particulate magnesium.

14. A method as claimed in claim 8 or 9 or 10 or 11 or 12 or 13 wherein all ingredients are less than 30 mesh in particle size.

* * * * *